US007240656B2

(12) United States Patent
Yamane et al.

(10) Patent No.: US 7,240,656 B2
(45) Date of Patent: Jul. 10, 2007

(54) ELECTRIC OIL PUMP

(75) Inventors: Kosuke Yamane, Gunma-ken (JP); Masanori Umeno, Gunma-ken (JP); Keisuke Kashiwa, Gunma-ken (JP); Hirotaka Eno, Gunma-ken (JP)

(73) Assignee: Yamada Manufactoring Co., Ltd., Kiryu-Shi, Gunma-Ken (JP)

( * ) Notice: Subject to any disclaimer, the term of this patent is extended or adjusted under 35 U.S.C. 154(b) by 13 days.

(21) Appl. No.: 11/314,242

(22) Filed: Dec. 22, 2005

(65) Prior Publication Data

US 2006/0140805 A1 Jun. 29, 2006

(30) Foreign Application Priority Data

Dec. 28, 2004 (JP) ..... 2004-382149

(51) Int. Cl.
*F04C 2/18* (2006.01)

(52) U.S. Cl. ..... 123/196 R; 123/198 C

(58) Field of Classification Search ..... 123/196 R, 123/198 C, 198 DA, 553; 184/6.28, 6.27
See application file for complete search history.

(56) References Cited

U.S. PATENT DOCUMENTS 4,445,592 A * 5/1984 New et al. ..... 184/6.13
5,904,841 A * 5/1999 Penny ..... 210/130
5,934,241 A * 8/1999 Von Esebeck et al. .. 123/196 R
6,401,682 B1 * 6/2002 Nozue ..... 123/196 W
6,578,541 B2 * 6/2003 Stromsky et al. ..... 123/196 R
6,655,341 B2 * 12/2003 Westerbeke, Jr. ..... 123/196 R
6,948,606 B2 * 9/2005 Ida et al. ..... 192/85 AA
2002/0020385 A1 * 2/2002 Stromsky et al. ..... 123/196 R
2002/0088425 A1 * 7/2002 Westerbeke, Jr. ..... 123/196 R
2005/0039718 A1 * 2/2005 Tsutsumi et al. ..... 123/196 R

FOREIGN PATENT DOCUMENTS

JP 11-173278 6/1999

* cited by examiner

*Primary Examiner*—Stephen K. Cronin
*Assistant Examiner*—Jason Benton
(74) *Attorney, Agent, or Firm*—McGinn IP Law Group, PLLC

(57) ABSTRACT

An object of the invention is to provide an electric oil pump with greatly improved operation, increased endurance, and extended service life of an Oldham's coupling connecting a drive shaft that rotates a rotor in a pump housing and a motor output shaft in a motor housing.

The electric pump comprises a pump housing having a rotor and a drive shaft for rotatably supporting the rotor, and a motor housing connected to the pump housing and having an output shaft connected to the drive shaft via an Oldham's coupling. The pump housing is provided with a coupling chamber for accommodating the Oldham's coupling, and a linking channel for transporting the leaked oil from a rotor chamber accommodating the rotor of the pump housing to the coupling chamber.

8 Claims, 12 Drawing Sheets

ELECTRIC OIL PUMP

BACKGROUND OF THE INVENTION

1. Field of the Invention

The present invention relates to an electric oil pump that can greatly improve the operation, increase the endurance, and extend the service life of an Oldham's coupling connecting a drive shaft that rotates a rotor in a pump housing and a motor output shaft in a motor housing.

2. Description of the Related Art

Electric oil pumps comprising a combination of a pump housing having a drive shaft provided with a rotor of an inner contact gear type and a motor housing having a motor for rotating the drive shaft mounted on the rotor have been used as pumps in lubrication systems of automobiles or the like. A specific example of such electric oil pump is described in Japanese Patent Application Laid-open No. H11-173278. The essence of the invention disclosed in this application is that a hydraulic gear pump and a motor are connected via a bracket. A drive shaft on the side of the hydraulic gear pump and a rotor shaft on the side of the motor are connected via a coupling, and an Oldham's coupling is disclosed as an example of the coupling.

The construction of the Oldham' coupling disclosed in Japanese Patent Application Laid-open No. H11-173278 enables the rotation transfer even when the input shaft and output shaft are not coaxial. A plate-shaped protrusion is formed on the distal end of the output shaft of the motor, and a groove for inserting the protrusion is formed on the input shaft side of the pump housing. The output shaft of the motor rotates and the rotor shaft rotates in a state where the plate shaped protrusion is inserted into the groove. In this case, the rotation is transferred even though the input shaft and output shaft are not coaxial, but the plate-shaped protrusion and the groove rub against each other and the surfaces thereof wear each other in long-term usage, thereby decreasing the strength of the coupling. It is an object of the present invention to increase the endurance and extend the service life of the Oldham's coupling connecting the output shaft and input shaft.

SUMMARY OF THE INVENTION

With the foregoing in view, the inventors have conducted a comprehensive study aimed at the resolution of the above-described problems, and the invention of claim 1 resolves the problems by providing an electric oil pump comprising a pump housing comprising a rotor and a drive shaft for rotatably supporting the rotor, and a motor housing connected to the pump housing and having an output shaft connected to the drive shaft via an Oldham's coupling, wherein a coupling chamber for accommodating the Oldham's coupling and a linking channel for transporting the leaked oil from a rotor chamber of the pump housing where a rotor is accommodated to the coupling chamber are provided in the pump housing.

The invention of claim 2 resolves the problems by providing an electric oil pump comprising a pump housing having a cover section having a bearing hole formed therein, a pump body section having a rotor chamber formed therein, and a base section having a shaft through hole and a coupling chamber connected to the shaft through hole and opened outwardly, a drive shaft rotatably supported by the bearing hole and shaft through hole and protruding into the coupling chamber, a rotor accommodated in the rotor chamber, and a motor housing comprising an output shaft connected by an Oldham's coupling to the drive shaft protruding into the coupling chamber, wherein an annular drain groove is formed between the cover section and the pump body section or between the pump body section and the base section, surrounding the rotor chamber; and a linking channel for linking the annular drain groove and the coupling chamber is formed in the pump body section and the base section.

Furthermore, the invention of claim 3 resolves the problems by providing the electric oil pump of the above-described configuration, wherein an annular drain groove surrounding the rotor chamber is formed between the cover section and pump body section and between the pump body section and base section.

The invention of claim 4 resolves the problems by providing the electric oil pump of the above-described configuration, comprising a discharge channel leading from the linking channel to an oil pan, wherein the position of the coupling chamber is below the position of a discharge section provided in the oil pan. The invention of claim 5 resolves the problems by providing the electric oil pump of the above-described configuration, wherein a linking channel is formed between the bearing hole and the annular drain groove in the cover section.

With the invention of claim 1, a linking channel for transporting the leaked oil from a rotor chamber of the pump housing where a rotor is accommodated to the coupling chamber is provided in the Oldham's coupling. Therefore, the oil constantly spreads to the rubbing zone in the Oldham's coupling accommodated in the coupling chamber, good and stable rotation transfer is carried out from the output shaft of the motor housing to the drive shaft of the pump housing, and excellent endurance can be attained.

Furthermore, with the invention of claim 2, because an annular drain groove surrounding the rotor chamber is formed between the cover section and the pump body section, the leaked oil from the rotor chamber can be reliably removed by the annular drain groove and the leaked oil can be effectively pumped, practically without any waste, to the coupling chamber. Other effects are almost identical to those of the invention of claim 1. Furthermore, with the invention of claim 3, forming annular drain grooves on both sides in the axial direction of the pump body section makes it possible to remove the leaked oil from both surfaces of the rotor chamber and to conduct rapid oil supply to the coupling chamber.

With the invention of claim 4, providing a discharge channel leading from the linking channel to the oil pan makes it possible to pump the oil from the coupling chamber to the oil pan when the amount of leaked oil increases and pressure rises. Furthermore, because the coupling chamber is positioned below the discharge section provided in the oil pan, the coupling chamber can be maintained in a state where it is filled with oil.

With the invention of claim 5, a linking channel is formed between the bearing hole and the annular drain groove. As a result, oil penetrates to the periphery of the shaft and lubrication can be ensured between the shaft and the bearing hole or the bearing, e.g., the shaft through hole. Furthermore, because the bearing holes in both end sections of the shaft and the coupling chamber are linked by the linking channel, they have the same pressure, the shaft is not displaced axially by the difference in pressure between the two end sections of the shaft, and stable rotation operation of the shaft can be ensured.

DESCRIPTION OF THE PREFERRED EMBODIMENTS

Figure 1:
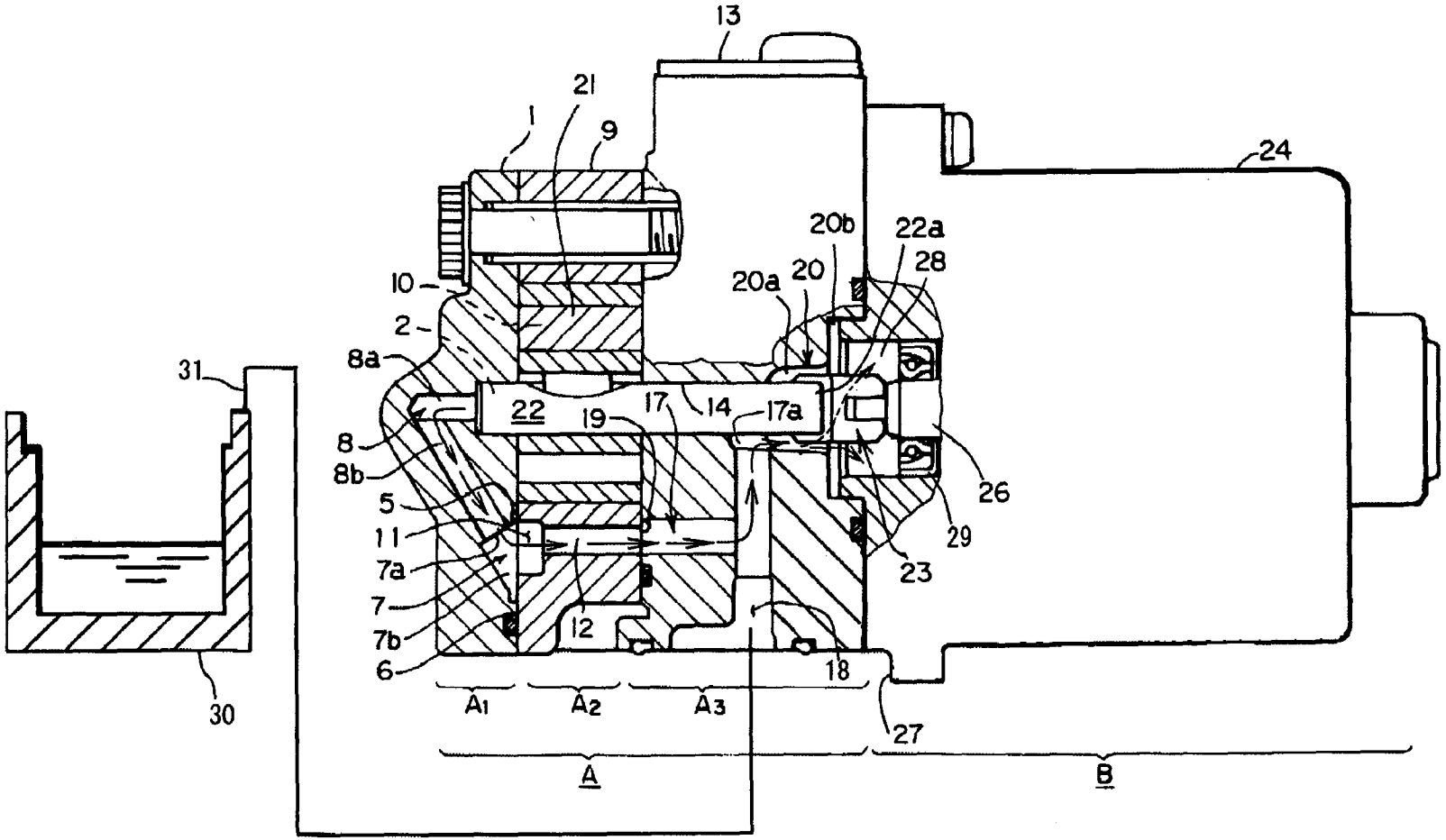
FIG. 1 is a side view with partial vertical cut-out illustrating the configuration of the present invention.
Figure 6:
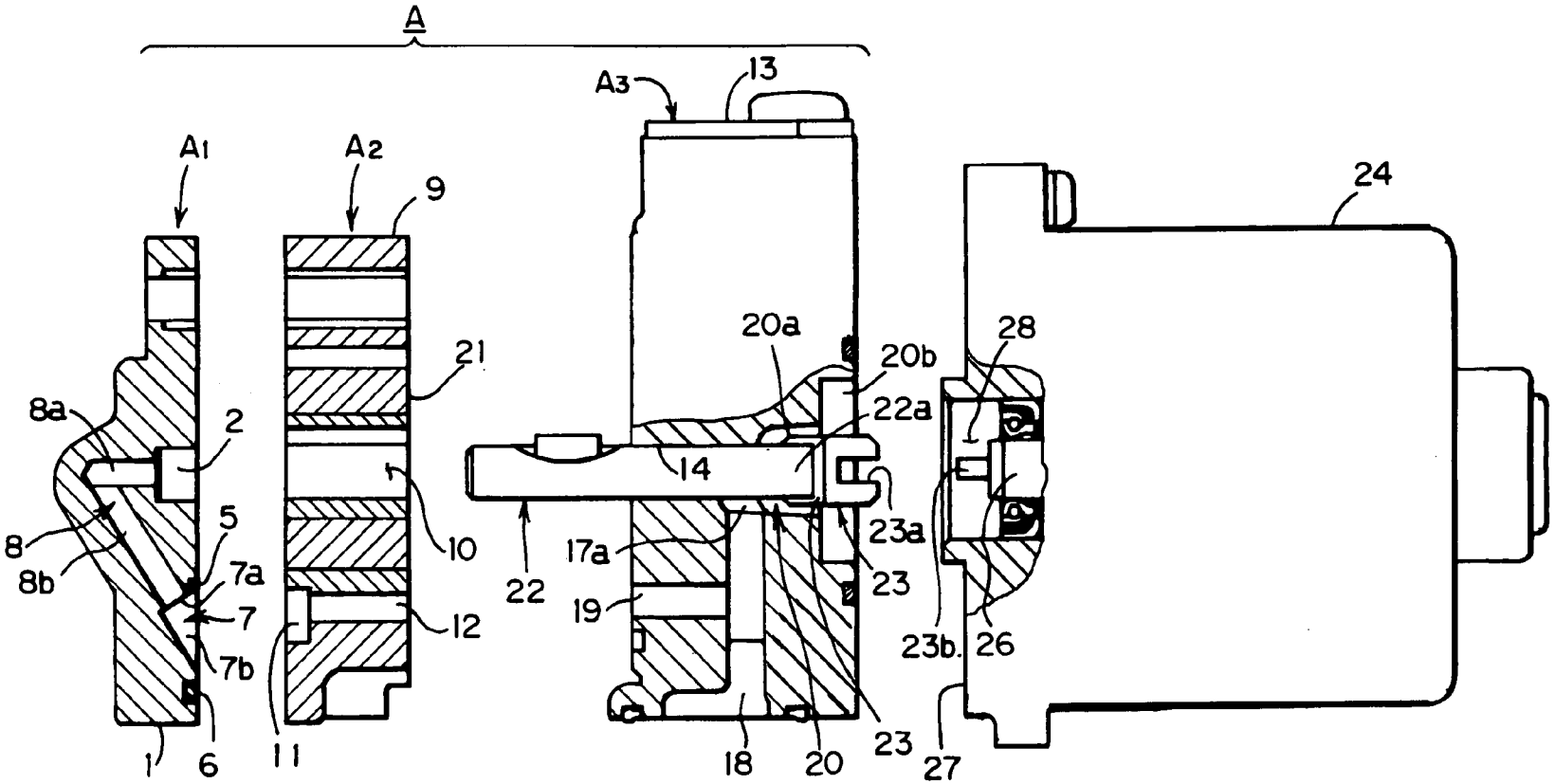
FIG. 6 is an exploded side view with a partial vertical section illustrating the present invention.

Embodiments of the present invention will be described below based on the appended drawings. As shown in FIG. 1 and FIG. 6, the electric oil pump in accordance with the present invention comprises a pump housing A, a motor housing B, a rotor 21, and a drive shaft 22. The rotor 21 and drive shaft 22 are mounted inside the pump housing A. The pump housing A comprises a cover section $A_1$, a pump body section $A_2$, and a base section $A_3$, and those cover section $A_1$, pump body section $A_2$, and base section $A_3$ are joined via a fastener such as bolts and screws along the axial direction of the drive shaft 22 contained therein.

Figure 2A:
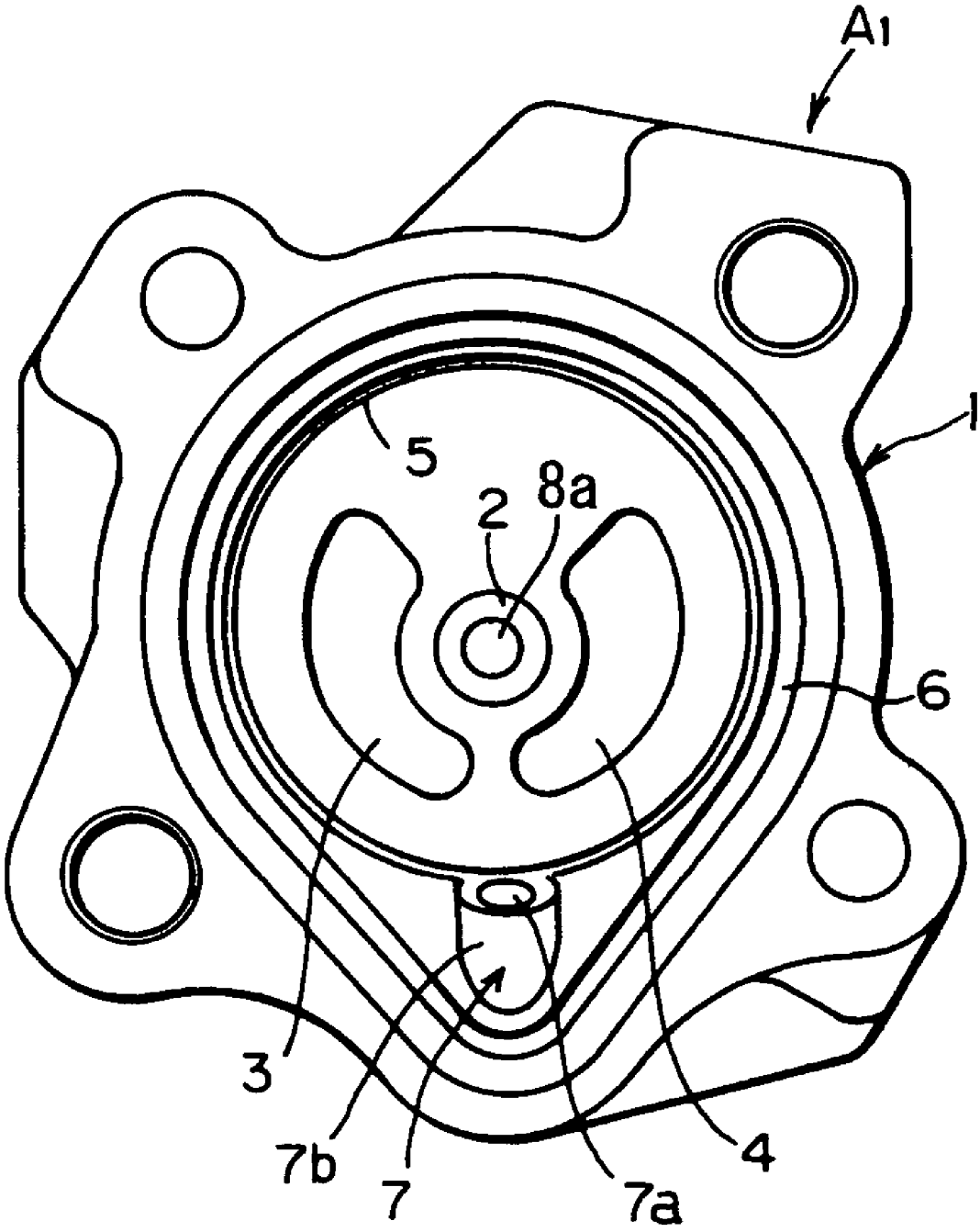
FIG. 2(A) is a front view of the cover section, (B) is a sectional side view of (A)
Figure 4A:
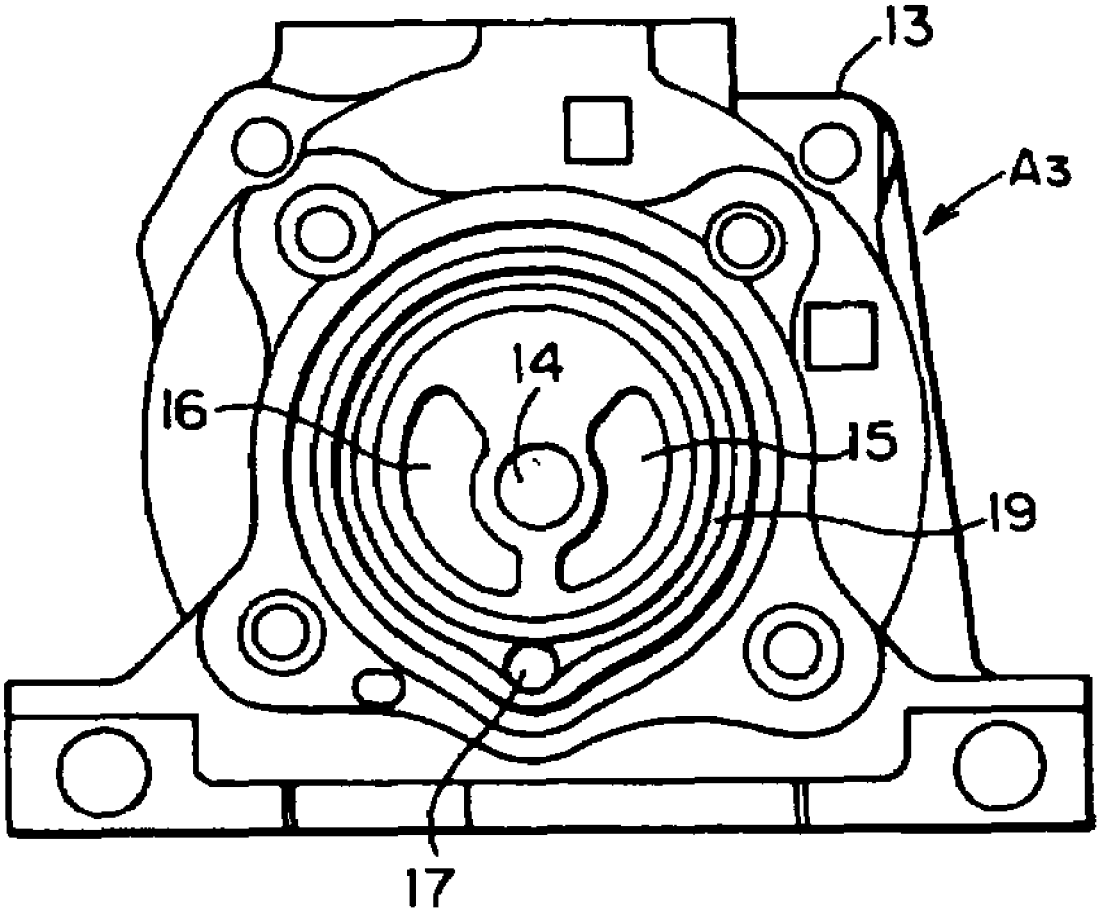
FIG. 4(A) is a front view of the base section, (B) is a sectional side view of (A), (C) is a cross-sectional view of the main portion of (A)

As shown in FIG. 1 and FIG. 6, the cover section $A_1$ mainly comprises a cover body 1 and a bearing hole 2. The bearing hole 2 is formed on the side of the surface of the cover body 1 where it is joined to the pump body section $A_2$. The bearing hole 2 serves to support the drive shaft 22 inserted therein. Furthermore, as shown in FIG. 2, port recesses 3, 4 are formed around the bearing hole 2. As shown in FIG. 4(A), the port recesses 3, 4 correspond to the positions of an intake port 15 and a discharge port 16 formed in the base section $A_3$ and have almost the same shape in the plane thereof as those intake port 15 and discharge port 16. Furthermore, the port recesses 3, 4 are in the form of shallow grooves.

Figure 2B:
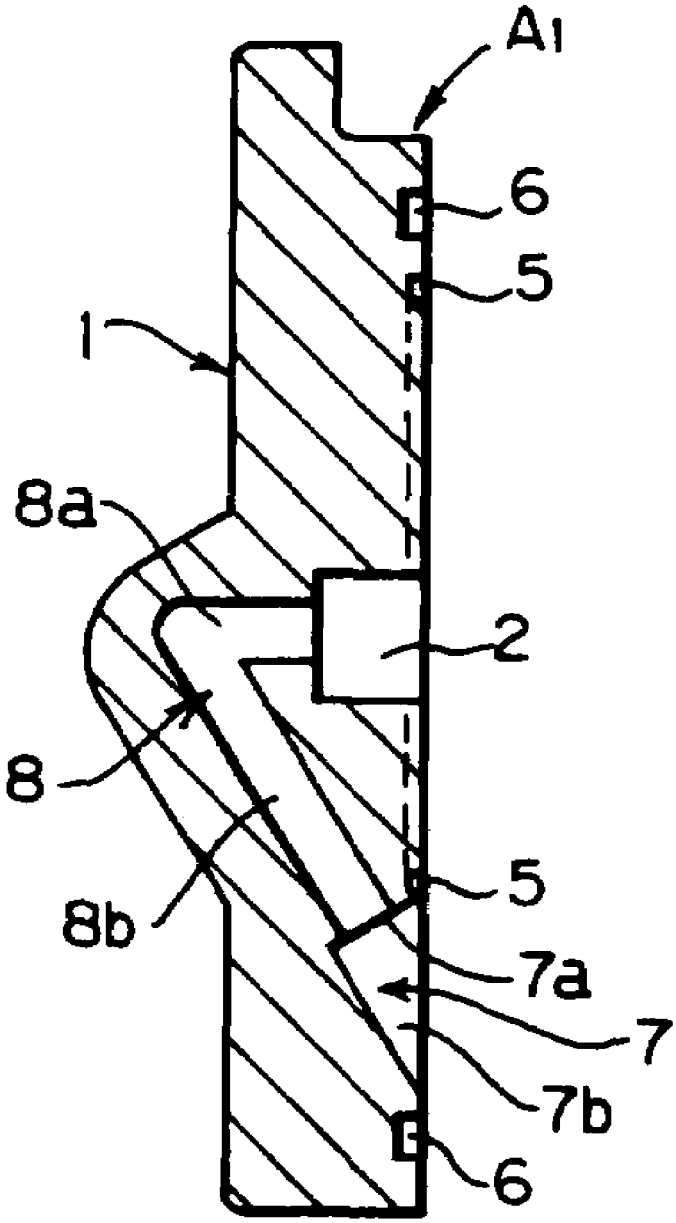
Figure 3A:
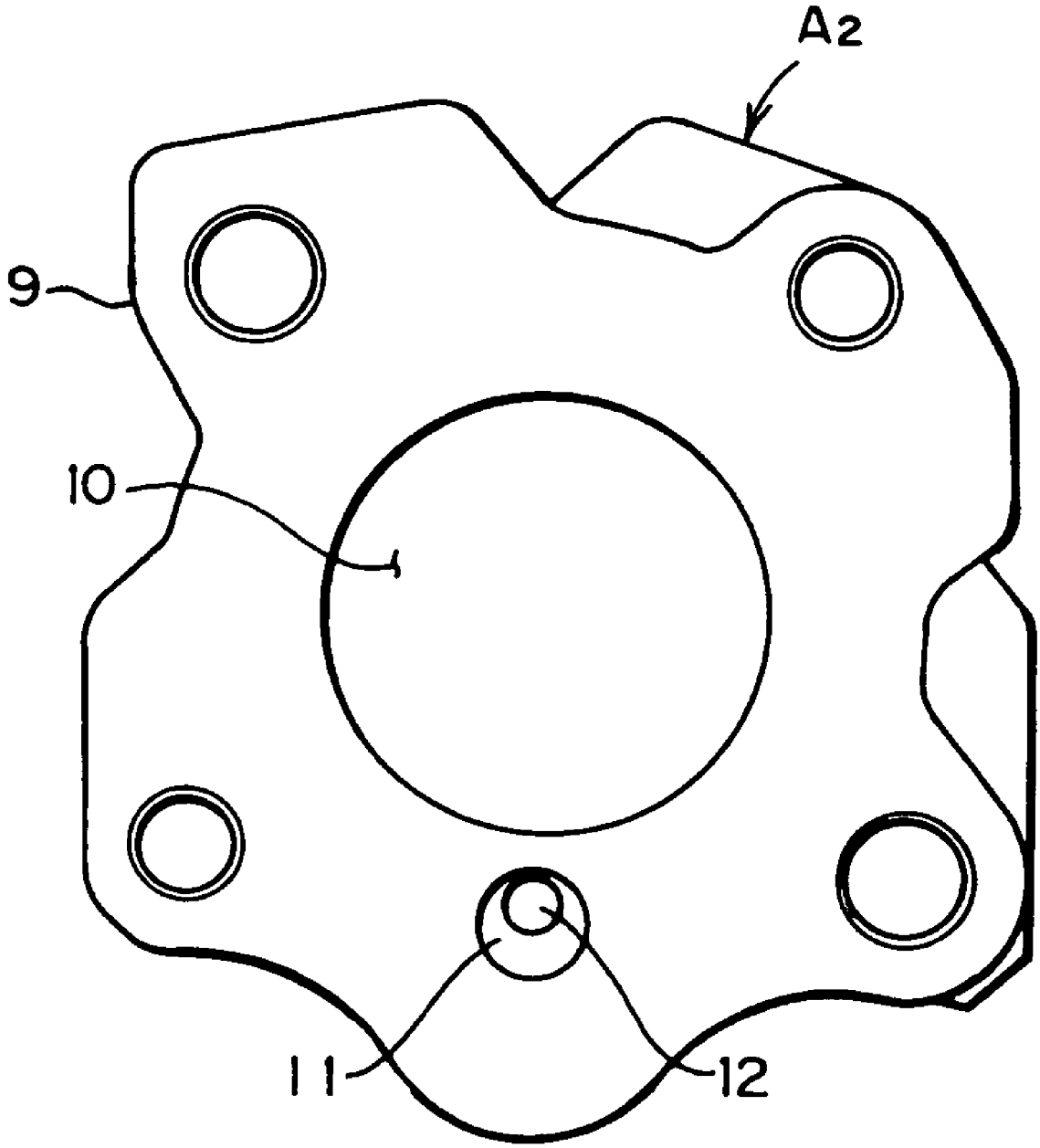
FIG. 3(A) is a front view of the pump body section, (B) is a sectional side view of (A)
Figure 3B:
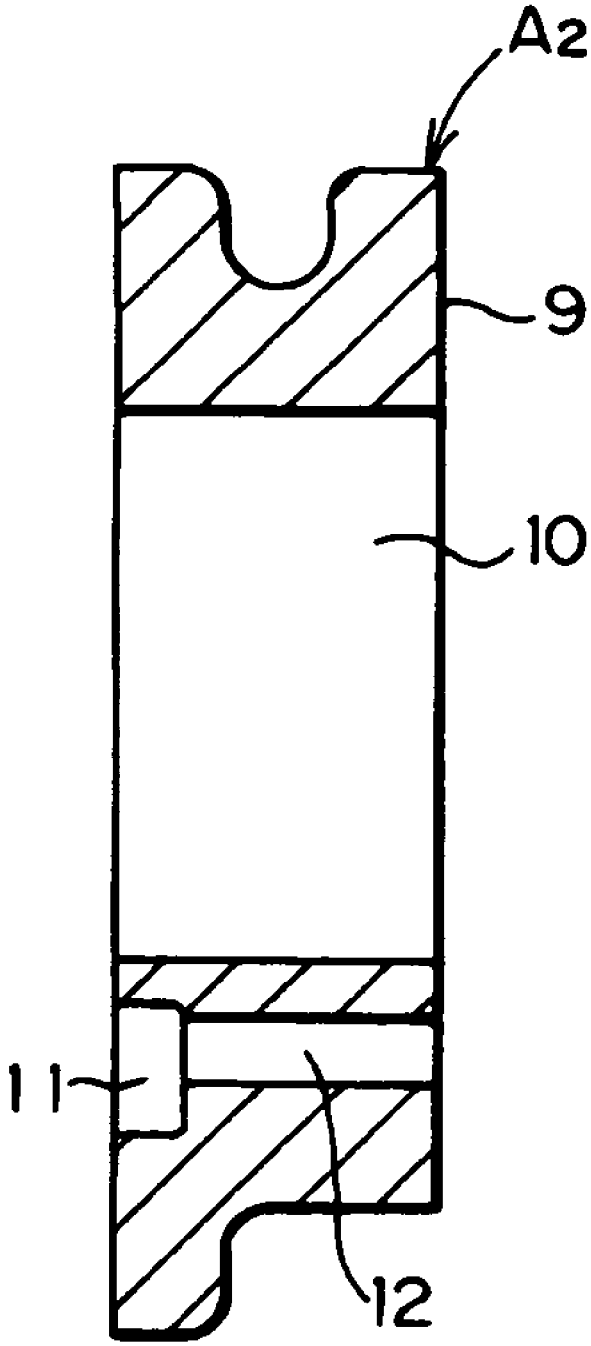

Furthermore, as shown in FIG. 2, an annular drain groove 5 is formed so as to surround the port recesses 3, 4. Furthermore, a seal groove 6 is formed on the outside of the annular drain groove 5. A drain hole section 7 is formed between the annular drain groove 5 and seal groove 6. The annular drain groove 5 is formed to surround from the outside the region of a rotor chamber 10 formed in the pump body section $A_2$, and makes it possible to remove the leaked oil. The drain hole section 7 is formed to be located specifically in the lower portion of the cover section $A_1$ and crosses the annular drain groove 5 on the lower side thereof. The leaked oil flowing in the annular drain groove 5 is collected in the drain hole section 7 (see FIG. 2(B)). As shown in FIG. 1 and FIG. 2, this drain hole section 7 comprises a hole opening 7*a* and a feed guide recess 7*b*. The leaked oil that flowed out from the hole opening 7*a* can be transferred in a stable state thereof along the feed guide recess 7*b* to the main oil hole section 11 of the below-described pump body section $A_2$.

The drain hole section 7 and bearing hole 2 are linked together via a first linking channel 8. The first linking channel 8 passes through inside the cover body 1 of the corner section $A_1$ and serves to pump out the oil that leaked to the bearing hole 2 into the drain hole section 7. The linking location of the first linking channel 8 and the bearing hole 2 comprises an axial linking passage 8*a* with an inner diameter less than the bearing hole 2 and matching the linking location in the axial direction of the bearing hole 2 and a drain-side linking passage 8*b* linked to the drain hole section 7, and the channel is formed by the intersection of the axial linking passage 8*a* and drain-side linking passage 8*b* (see FIG. 2(B)).

Furthermore, the pump body section $A_2$ is disposed between the cover section $A_1$ and base section $A_3$, as shown in FIG. 6. The rotor chamber 10 in the form of a through hole accommodating the rotor 21 is formed in a body main unit 9. The main oil hole section 11 is formed in the position corresponding to the drain hole section 7 on the side of the surface of the pump body section $A_2$ that is joined to the cover section $A_1$, and a second linking channel 12 is formed so as to pass from the main oil hole section 11 toward the surface of the pump body section $A_2$ that is joined to the base section $A_3$.

The inner diameter of the main oil hole section 11 is formed larger than the inner diameter of the second linking channel 12. The main oil hole section 11 serves to receive the leaked oil from the drain hole section 7 of the cover section $A_1$ and feed the leaked oil to the second linking channel 12. Thus, the second linking channel 12 is linked to the first linking channel 8 and annular drain groove 5 formed in the cover section $A_1$ via the drain hole section 7, and this second linking channel 12 transfers the oil that flowed in from the annular drain groove 5 of the cover section $A_1$ and the first linking channel 8 to a coupling chamber 20 formed in the base section $A_3$.

As shown in FIG. 6, in the base section $A_3$, a shaft through hole 14 is formed in a base main unit 13. Together with the bearing hole 2 formed in the cover section $A_1$, the shaft through hole 14 serves as a bearing rotatably supporting the drive shaft 22. As shown in FIGS. 4(A) and (C), the intake port 15 and discharge port 16 are formed around the shaft through hole 14 of the base main unit 13. Those intake port 15 and discharge port 16 are formed to match the positions of the port recesses 3, 4 when the pump body section $A_2$ and base section $A_3$ are joined together (see FIG. 1). The intake port 15 passes through to an oil pan 30 disposed on the outside of the pump housing A (see FIG. 1 and FIG. 7).

Figure 4B:
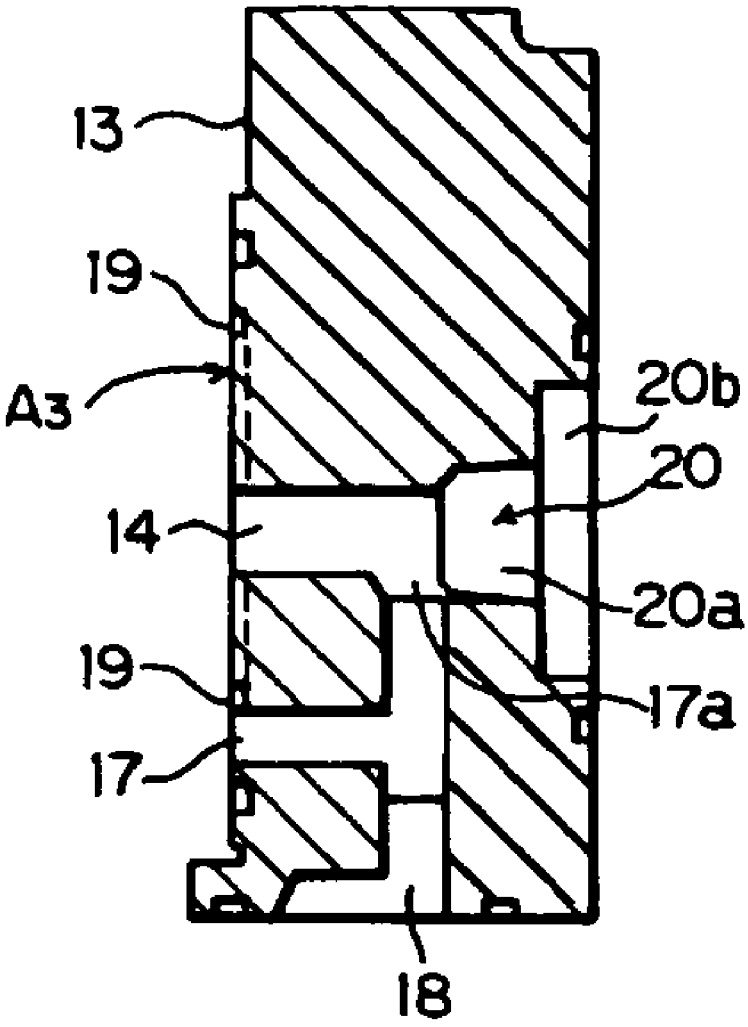
Figure 4C:
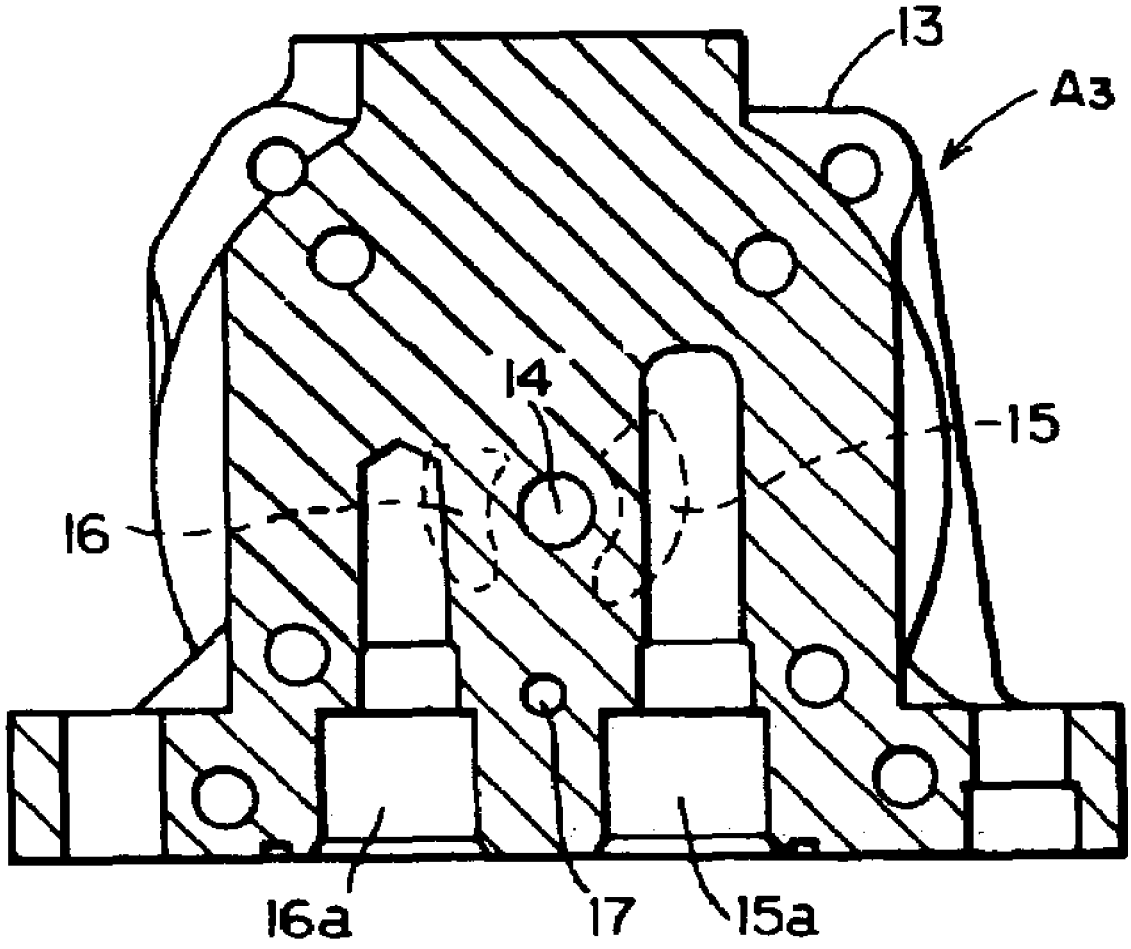

A third linking channel 17 is formed in the base main unit 13. The third linking channel 17 is configured to be linked to the second linking channel 12 when the pump body section $A_2$ and base body $A_3$ are joined together. As shown in FIG. 1(A) and FIG. 4(B), the third linking channel 17 is linked to the shaft through hole 14. More specifically, a drain opening section 17*a* is formed in the location where the shaft through hole 14 and the third linking channel 17 intersect. The drain opening section 17*a* is formed as a zone expanding radially in part of the shaft through hole 14 and makes it possible to pump out the sufficient amount of oil transported from the third linking channel 17 to the shaft through hole 14 in the drain opening section 17*a* .

Figure 7:
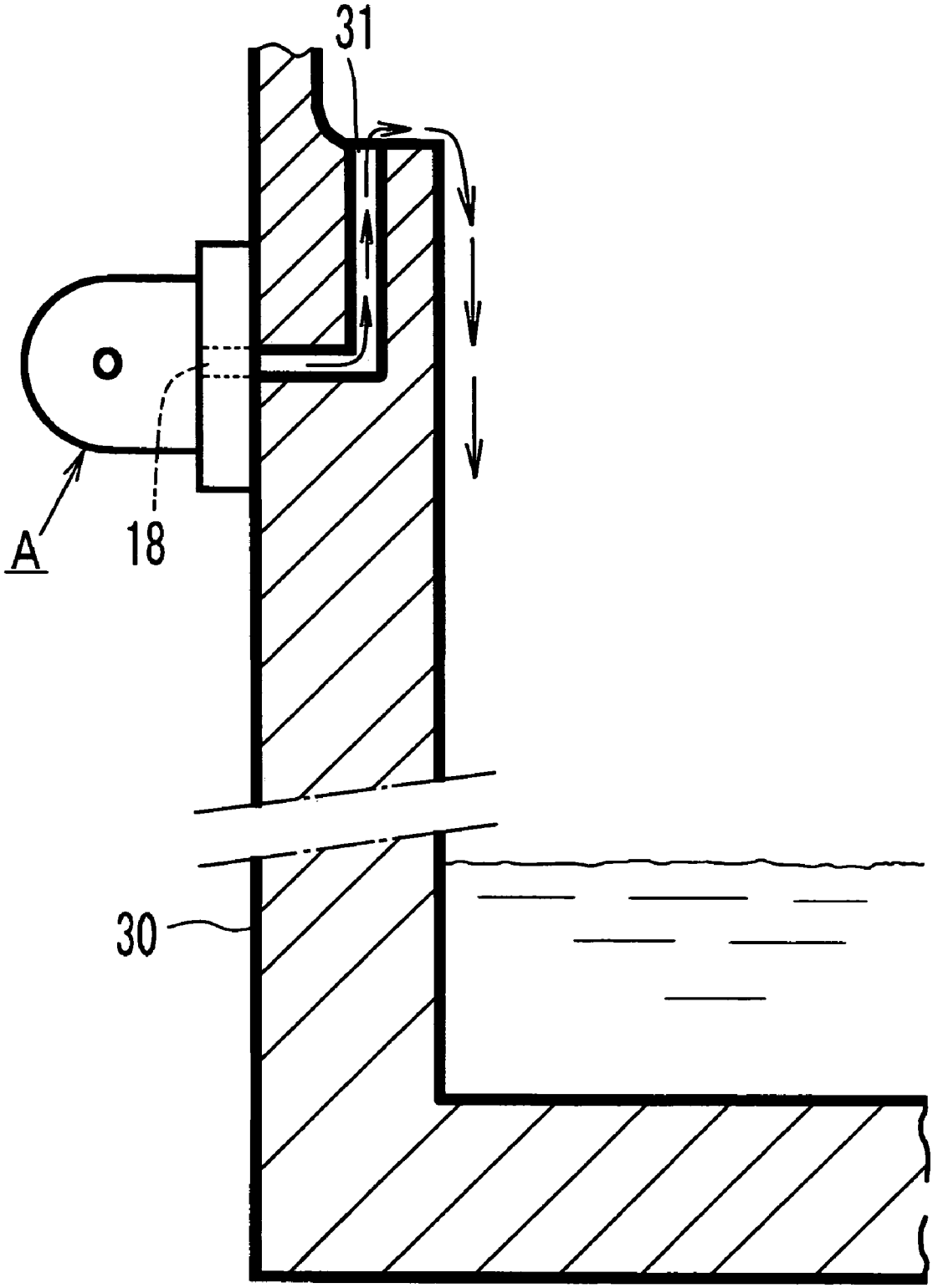
FIG. 7 illustrates schematically the operation in which an electric oil pump in accordance with the present invention is mounted on an oil pan and the leaked oil is discharged from the discharge section into the oil pan.

Furthermore, a discharge channel 18 linked to the oil pan 30 is formed in the third linking channel 17. As shown in FIG. 7, the discharge channel 18 is linked to a discharge section 31 provided in the oil pan 30. Furthermore, the position of the discharge section 31 provided in the oil pan 30 is set to be higher than the coupling chamber 20. Owing to such a configuration, when the amount of leaked oil increased and pressure rises, the oil can be pumped out to the oil pan 30 via the discharge section 31 and also via the coupling chamber 20. Furthermore, because the coupling chamber 20 is positioned below the discharge section 31 of the oil pan 30, the coupling chamber 20 can be almost constantly maintained in a state in which it is filled with oil. A second annular drain groove 19 is formed in the surface of the base section $A_3$ where the base section is joined to the pump body section $A_2$. The second annular drain groove 19 crosses the third linking channel 17, and the oil present in the second annular drain groove 19 is caused to flow into the third linking channel 17. Forming the two drain grooves makes it possible to remove the leaked oil from both surfaces of the rotor chamber and supply the rapidly flowing oil to the coupling chamber 20.

Furthermore, as shown in FIG. 4(B), the coupling chamber 20 is formed in the base main unit 13 of the base section $A_3$ in the joint surface thereof with the motor housing B. The coupling chamber 20 is formed as an almost cylindrical receding zone in the joining outer wall surface of the base main unit 13. The coupling chamber 20 is linked to the shaft through hole 14. The coupling chamber 20 comprises a leaked oil pool section 20*a* with an inner diameter slightly larger than that of the shaft through hole 14 and a guide section 20*b* serving as a guide for joining to the motor housing B. The leaked oil is accumulated in the leaked oil pool section 20*a* and part of the guide section 20*b*. The drive shaft 22 is disposed inside the coupling chamber 20 of the bump housing A. Furthermore, the drive shaft 22 is connected to an output shaft 26 of the monitor housing B via an Oldham's coupling 23.

As shown in FIG. 6, in the above-described cover section $A_1$, pump body section $A_2$, and base section $A_3$, a rotor 21 constituting a pump with internal contact gears such as torodial gears is contained in the rotor chamber 10 of the pump body section $A_2$, and the drive shaft 22 is mounted on the rotor 21 on the drive side thereof via a key or the like. Rotational support is provided by the bearing hole 2 on the side of the cover section $A_1$ and the shaft through hole 14 on the side of the base section $A_3$. More specifically, one end of the drive shaft 22 in the axial direction is the portion fixedly attached to the rotor 21 and supported in the bearing hole 2. The other end side of the drive shaft 22 in the axial direction thereof becomes an input side and serves for connection to the output shaft 26 of the motor housing B. The end portion 22*a* on the input side of the drive shaft 22 is connected to the output shaft of the motor housing B via the Oldham's coupling 23. A shaft seal 29 is provided on the motor section side in the coupling chamber 20 to seal the oil located inside the coupling chamber 20.

In the motor housing B, the motor section is mounted inside a housing main unit 24, and the output shaft 26 of the motor section. Furthermore, the output shaft 26 of the motor section is disposed inside a flange section 27. The flange section 27 is connected to the base section $A_3$ of the pump housing A via a fastener such a screw or a bolt. A second coupling chamber 28 enabling the Oldham's coupling 23 to be inserted and disposed therein is also provided in the flange section 27.

Figure 5:
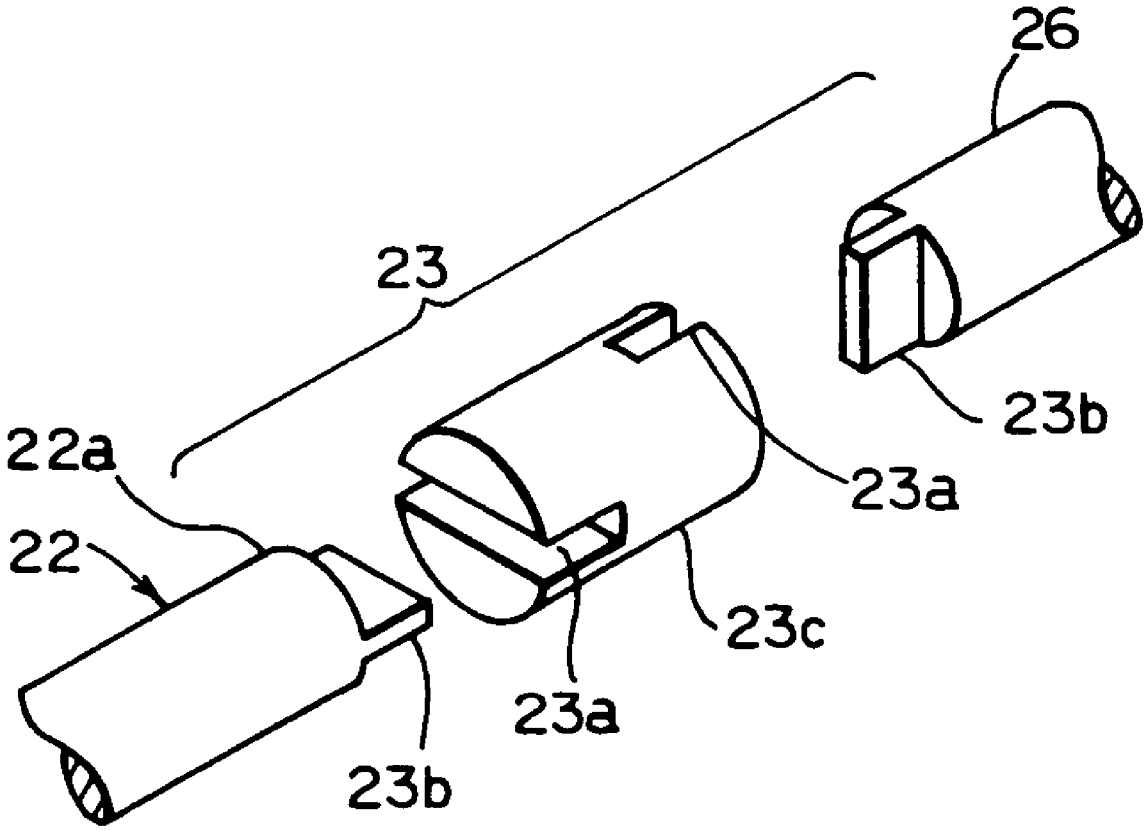
FIG. 5 is an exploded perspective view of an Oldham's coupling.

As shown in FIG. 5, the Oldham's coupling 23 comprises insertion groove sections 23*a* and insertion plate sections 23*b*. The insertion plate sections 23*b* are formed in the end portion 22*a* on the input side of the drive shaft 22 and the distal end portion of the output shaft 26, and the insertion groove sections 23*a* are formed on both sides in the axial direction of a joint member 23*c*. The insertion plate sections 23*b* of the drive shaft 22 and output shaft 26 are configured to be inserted into respective insertion groove sections 23*a* formed in the joint member 23*c*.

A configuration is also possible in which respective insertion grooves 23*a* are formed in the drive shaft 22 and output shaft 26, and the insertion plate sections 23*b*, 23*b* are formed in both sides in the axial direction of the joint member 23*c*. Furthermore, the joint members 23*c* are disposed in the coupling chamber 20 of the pump housing A and the second coupling chamber 28 of the motor housing B, the Oldham's coupling 23 of the drive shaft 22 and output shaft 26 is configured, while inserting the insertion plate sections 23*b* into the insertion grooves 23*a*, and the pump housing A and motor housing B are joined.

Figure 8:
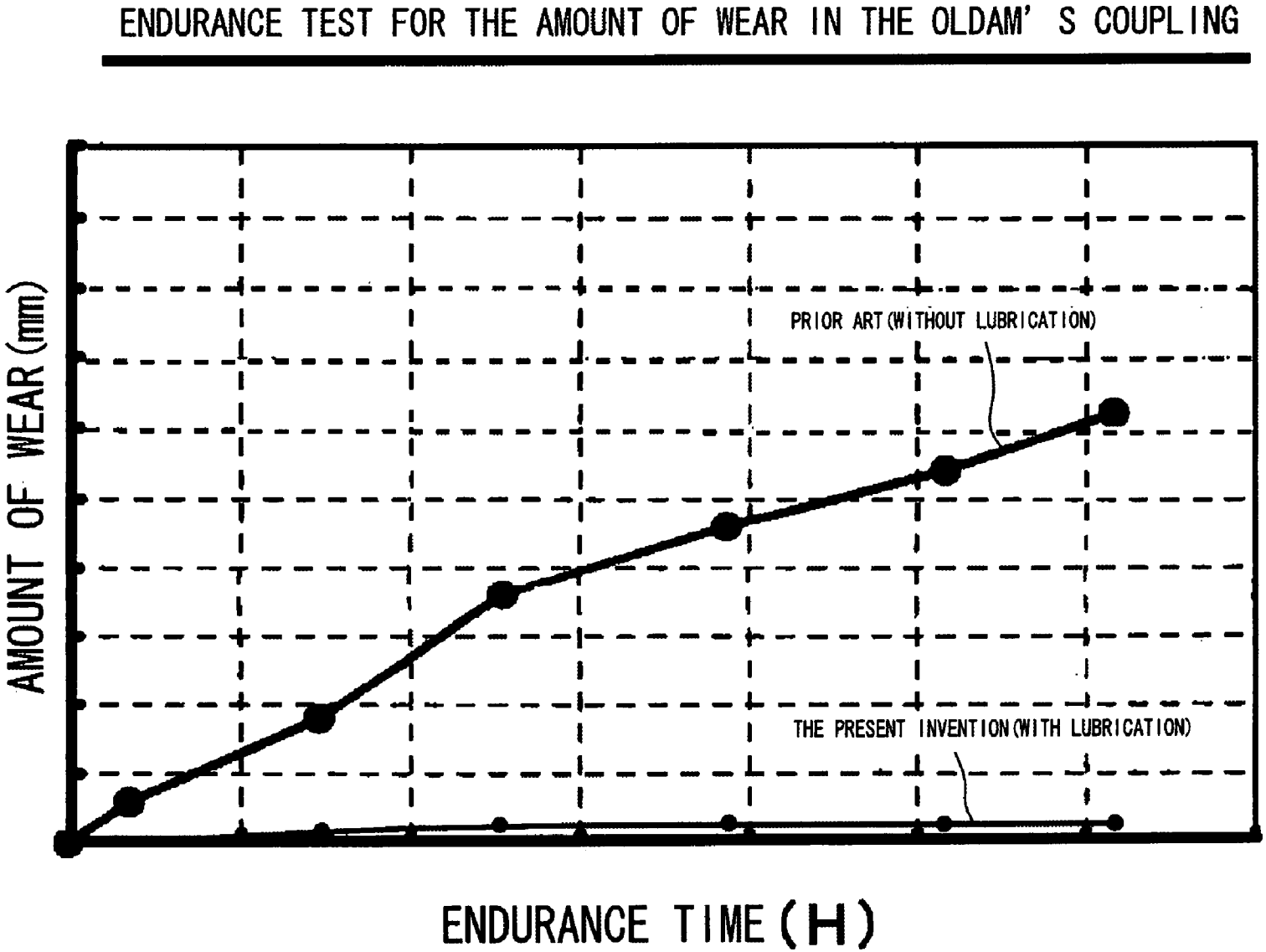
FIG. 8 is a graph comparing the performance of the pump in accordance with the present invention and the conventional pump.

FIG. 8 is a graph illustrating the amount of wear in the Oldham's coupling 23 with and without lubrication. The figure shows that feeding the leaked oil to the coupling chamber 20 in accordance with the present invention reduced the amount of wear in the rubbing zone of the Oldham's coupling 23.

What is claimed is:

1. An electric oil pump comprising:

a pump housing comprising a rotor and a drive shaft for rotatably supporting the rotor; and a motor housing connected to the pump housing and having an output shaft connected to the drive shaft via an Oldham's coupling, wherein a coupling chamber for accommodating the Oldham's coupling and a linking channel for transporting leaked oil from a rotor chamber of the pump housing where a rotor is accommodated to the coupling chamber are provided in the pump housing.

2. An electric oil pump comprising:

A pump housing having a cover section having a bearing hole formed therein, a pump body section having a rotor chamber formed therein, and a base section having a shaft through hole and a coupling chamber connected to the shaft through hole and opened outwardly;

A drive shaft rotatably supported by the bearing hole and shaft through hole and protruding into the coupling chamber;

A rotor accommodated in the rotor chamber; and

A motor housing comprising an output shaft connected by an Oldham's coupling to the drive shaft protruding into the coupling chamber, wherein An annular drain groove is formed between the cover section and pump body section or between the pump body section and base section, surrounding the rotor chamber, and A linking channel for linking the annular drain Groove and the coupling chamber is formed in the pump body section and base section.

3. The electric oil pumps according to claim 2, wherein

An annular drain groove surrounding the rotor chamber is formed between the cover section and pumps body section and between the pump body section and base section.

4. The electric oil pump according to claim 1, further comprising a discharge channel leading from the linking channel to an oil pan, wherein the position of the coupling chamber is below the position of a discharge section provided in the oil pan.

5. The electric oil pump according to claim 2, wherein a linking channel is formed between the bearing hole and the annular drain groove in the cover section.

6. The electric oil pump according to claim 2, further comprising a discharge channel leading from the linking channel to an oil pan, wherein the position of the coupling chamber is below the position of a discharge section provided in the oil pan.

7. The electric oil pump according to claim 3, further comprising a discharge channel leading from the linking channel to an oil pan, wherein the position of the coupling chamber is below the position of a discharge section provided in the oil pan.

8. The electric oil pump according to claim 3, wherein a linking channel is formed between the bearing hole and the annular drain groove in the cover section.

* * * * *

UNITED STATES PATENT AND TRADEMARK OFFICE

CERTIFICATE OF CORRECTION

PATENT NO. : 7,240,656 B2
APPLICATION NO. : 11/314242
DATED : July 10, 2007
INVENTOR(S) : Kosuke Yamane et al.

It is certified that error appears in the above-identified patent and that said Letters Patent is hereby corrected as shown below:

Title page Item (73) Assignee: should read, Yamada Manufacturing Co., Ltd.

Signed and Sealed this

Fourth Day of December, 2007

JON W. DUDAS
*Director of the United States Patent and Trademark Office*